US006811385B2

(12) United States Patent
Blakley

(10) Patent No.: US 6,811,385 B2
(45) Date of Patent: Nov. 2, 2004

(54) ACOUSTIC MICRO-PUMP

(75) Inventor: Daniel R. Blakley, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/286,092

(22) Filed: Oct. 31, 2002

(65) Prior Publication Data

US 2004/0086400 A1 May 6, 2004

(51) Int. Cl.[7] ..... F04B 17/00; F04B 7/00; F04B 19/24

(52) U.S. Cl. ..... 417/413.2; 417/413.3; 417/240; 417/410.1; 417/53

(58) Field of Search ..... 417/53, 315, 413.2, 417/413.3, 240, 241, 410.1

(56) References Cited

U.S. PATENT DOCUMENTS 4,171,852 A * 10/1979 Haentjens ..... 406/85
4,808,084 A * 2/1989 Tsubouchi et al. ..... 417/322
5,126,022 A 6/1992 Soane et al.
5,267,841 A 12/1993 Culp et al.
5,532,540 A * 7/1996 Claeyssen et al. ..... 310/323.16
5,660,528 A * 8/1997 Tsunenari ..... 417/32
5,892,314 A 4/1999 Sager et al.
5,925,970 A * 7/1999 Unami et al. ..... 310/328
6,007,309 A * 12/1999 Hartley ..... 417/322
6,010,316 A 1/2000 Haller et al.
6,045,208 A * 4/2000 Hirahara et al. ..... 347/10
6,210,128 B1 * 4/2001 Rife et al. ..... 417/322
6,232,129 B1 5/2001 Wiktor
6,247,905 B1 * 6/2001 Dohner ..... 417/322
6,274,964 B1 * 8/2001 Yoshida et al. ..... 310/321
2001/0055529 A1 12/2001 Wixforth

FOREIGN PATENT DOCUMENTS

WO WO 94/05414 * 3/1994 ..... B01F/11/02
WO WO 02/064821 8/2002

* cited by examiner

*Primary Examiner*—Justine R. Yu
*Assistant Examiner*—Timothy P. Solak

(57) ABSTRACT

A microfluidic device including a fluidic pumping system is provided. Some embodiments include a fluid-carrying channel, a plurality of acoustic pumping elements arranged along the fluid-carrying channel, wherein the acoustic pumping elements are configured to form an acoustic wave focused within the channel, and a controller in electrical communication with the plurality of acoustic pumping elements, the controller being configured to activate the acoustic pumping elements in such a manner as to cause the acoustic wave to move along the channel to move the fluid through the channel.

38 Claims, 3 Drawing Sheets

ACOUSTIC MICRO-PUMP

BACKGROUND

Recent advances in fluidic technology have led to the development of integrated chemical and biological analytical devices that place both electrical and fluidic systems on a single substrate. These devices sometimes are referred to as "laboratory-on-a-chip" devices, and may offer advantages over the use of larger, traditional analytical devices. For example, integrated analytical devices may consume smaller quantities of reagents and/or solvents, may occupy a smaller footprint in a laboratory, and/or may be easier to adapt for use in the field.

Fully or partially integrated chemical and biological analytical systems typically include a microfluidic network for moving fluids through the system. The term "microfluidic" typically refers to systems and processes for moving fluids through very small channels, for example, with micron-scale diameters. A microfluidic network may include a wide variety of components, including, but not limited to, valves for controlling access to fluid channels, mixers for mixing reaction components and/or carrier fluids, and pumps for moving fluids through the network.

Various types of pumps are known for use in microfluidics systems. For example, some microfluidics systems utilize mechanical pumps that move fluids through the system via mechanically created pressure differentials. However, such pumping devices may be difficult to fabricate, and also may be damaged by impurities in the sample. Other microfluidics systems may utilize electroosmotic pumping devices, in which an electric field is used to drive a polar fluid through a channel. However, these systems may utilize a high voltage (on the order of kilovolts) to drive movement of the fluid, and may be sensitive to impurities that adsorb to the wall of the channel. Furthermore, electroosmotic pumping devices may not be able to pump effectively nonpolar or only slightly polar solvents.

SUMMARY

Some embodiments of the present invention provide a microfluidic device including a fluidic pumping system. The fluidic pumping system includes a fluid-carrying channel, a plurality of acoustic pumping elements arranged along the fluid-carrying channel, wherein the acoustic pumping elements are configured to form an acoustic wave focused within the channel, and a controller in electrical communication with the plurality of acoustic pumping elements, the controller being configured to activate the acoustic pumping elements in such a manner as to cause the acoustic wave to move along the channel to move the fluid through the channel.

DETAILED DESCRIPTION

Figure 1:
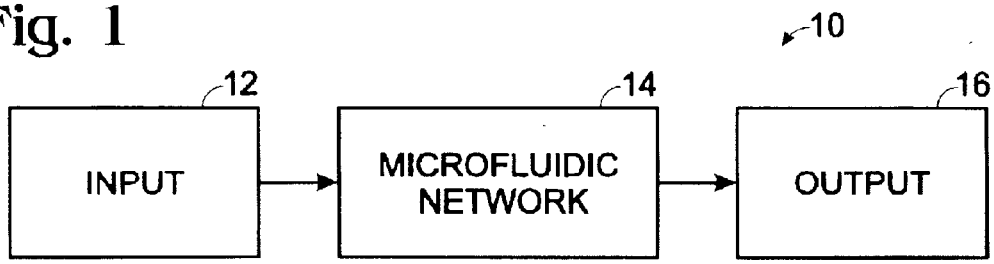
FIG. 1 is a block diagram of an integrated analytical device according to an embodiment of the present invention.

FIG. 1 shows, generally at 10, a simplified block diagram of a microfluidic device according to an embodiment of the present invention. Microfluidic device 10 includes an input 12, a microfluidic network 14, and an output 16.

Input 12 is configured serve as an interface between microfluidic network 14 and macroscopic components positioned upstream of the microfluidic network in an overall process flow, and may be configured to accept the introduction of one or more fluids into device 10. Any suitable fluid may be introduced into microfluidic device 10 via input 12. Examples include, but are not limited to, biological or chemical samples contained within a liquid- or gas-phase carrier, and solvents, reagents, and other chemical components.

Input 12 may include a single input for receiving a single analytical sample mixture, or may include multiple individual inputs for receiving a plurality of substances. For example, input 12 may include a plurality of sample inputs that allow multiple samples to be introduced simultaneously to microfluidic device 10 for sequential or parallel processing. Input 12 may also include a plurality of reagent inputs configured to introduce one or more reagents for reaction with a sample. Furthermore, input 12 may include electrical inputs configured to accept electrical signals for controlling and/or powering the various components of microfluidic network 14.

Likewise, output 16 is configured to serve as an interface between microfluidic network 14 and macroscopic components that are positioned downstream of the microfluidic network in an overall process flow. Output 16 may include both electrical and fluidic outputs. For example, output 16 may include a fluidic output configured to deposit waste fluids into a waste receptacle, or to route fluids into analytical instruments after processing within microfluidic network 14. Output 16 may also include electrical outputs configured to output electrical signals. Examples of electrical signals that may be output from microfluidic network 14 include, but are not limited to, raw or processed data signals from an integrated sensor and/or circuit formed within microfluidic network 14.

Microfluidic network 14 may have any desired selection and arrangement of microfluidic components suitable for performing a selected task. Exemplary components that may be included in microfluidic network 14 include, but are not limited to, mixers, storage chambers, separation columns, and channels, valves and pumping systems for connecting the various components.

Figure 2:
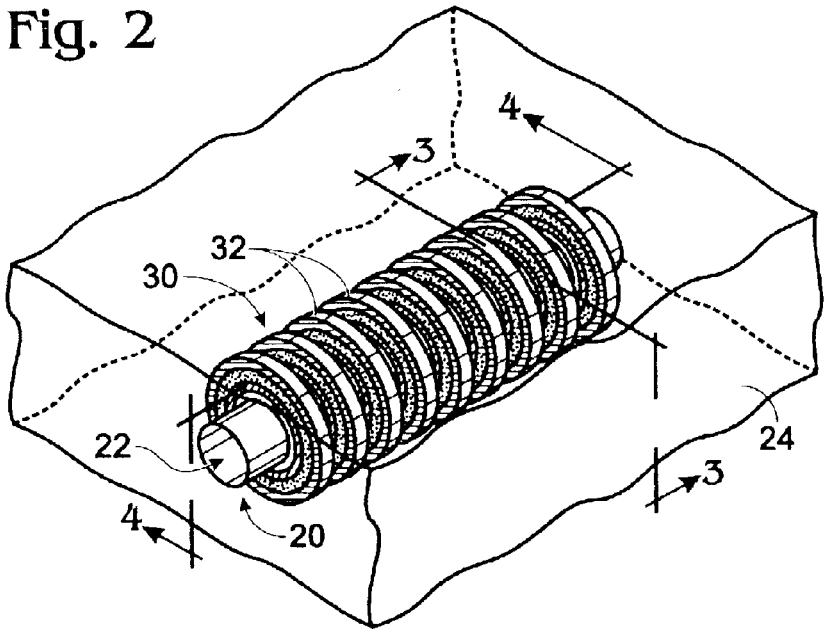
FIG. 2 is an isometric view of a pumping system of the microfluidic network of the embodiment of FIG. 1.

FIG. 2 shows, generally at 20, an exemplary channel structure and, generally at 30, a pumping system from microfluidic network 14 for moving a fluid through the microfluidic network. Channel structure 20 includes a fluid-carrying channel 22 formed within a substrate 24 that is configured to carry a, fluid between components within microfluidic network 14. Channel structure 20 may also include a corrosion-resistant material 26 (FIG. 3) to protect the inner surfaces of the channel from corrosive fluids. Alternatively, channel structure may not include material 26 on its inner surface, if the fluids being pumped are not significantly corrosive to the materials used to form channel structure 20. In these embodiments, the inner surface of the channel may be at least partially formed by pumping elements 32 of pumping system 30, which are described in more detail below. Pumping system 30 is configured to move fluids through channel 22 via the formation of focused acoustic waves within the channel. Pumping system 30 may also be configured to move the acoustic waves along the length of channel 22 to create a peristaltic pumping effect. To form the acoustic waves, pumping system 30 includes a plurality of individual pumping elements 32 disposed along the length of channel 22. While FIG. 2 shows nine pumping elements 32 spaced evenly along the length of channel 22, it will be appreciated that any suitable number of pumping elements may be disposed along the length of the channel. Furthermore, while the depicted pumping elements 32 are evenly spaced along the length of channel 22, the pumping elements may also be spaced in any other manner along the length of the channel suitable to cause an acoustic wave to be focused at a desired location within the channel.

Figure 3:
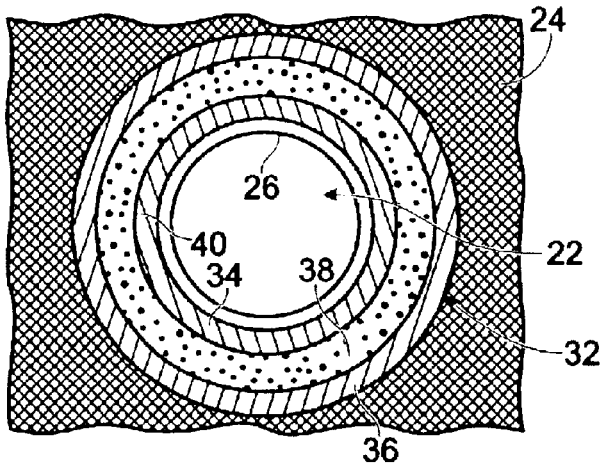
FIG. 3 is a front sectional view of a pumping element taken along line 3—3 of FIG. 2.
Figure 4:
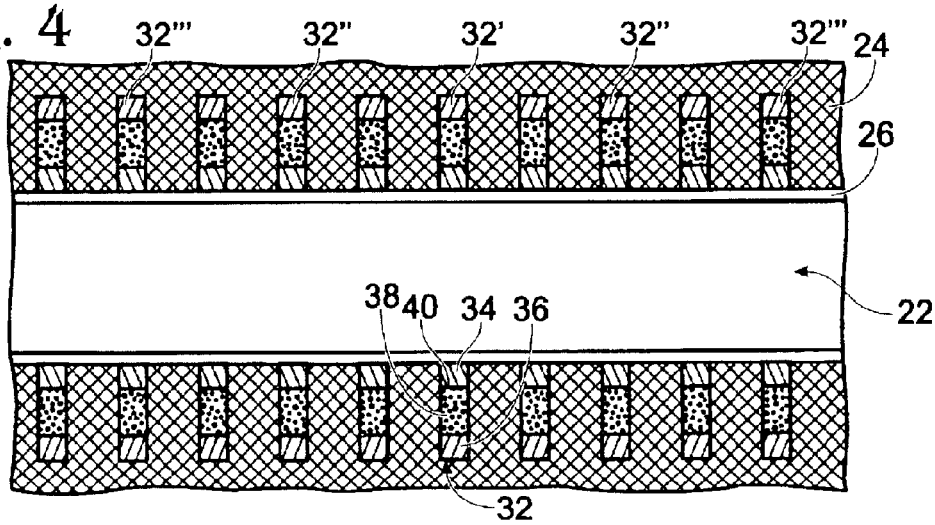
FIG. 4 is a side sectional view of a plurality of pumping elements taken along line 4—4 of FIG. 2.

Pumping elements 32 are shown in more detail in FIGS. 3–4. Each pumping element includes an inner electrode 34, an outer electrode 36, and a piezoelectric element 38 positioned between the inner and outer electrodes. The depicted pumping elements have a ring-shaped configuration, and concentrically surround channel 22. The application of a voltage pulse across piezoelectric element 38 via inner electrode 34 and outer electrode 36 causes the piezoelectric element to change physical dimensions, which thus creates a ring-shaped acoustic wave. The pulse may be of a constant voltage, or may be of a periodic voltage. Where a pulse of a periodic voltage is used to activate pumping elements 32, the acoustic energy from one or more pumping elements 32 may constructively add at a selected location within channel 22, herein after referred to as the "focal region," to form a focused acoustic wave within the channel via acoustic Fresnel diffraction. It will be appreciated that, where protective material 26 is used to coat the interior of channel 22, the layer of material 26 may be segmented in some manner to form expansion joints to allow the material to withstand the contractions and expansions of piezoelectric elements 38.

When an acoustic wave formed by one or more pumping element 32 is focused in channel 22, the pressure at the focal region is increased relative to the areas within channel 22 adjacent the focal region. This increase in local pressure at the focal region may drive a fluid within channel 22 away from the focal region. In this manner, a fluid may be moved along channel 22 by applying a pattern of pulses to the plurality of pumping elements 32 in a progressive manner along the length of channel 22.

The plurality of pumping elements 32 may be activated in any number of different patterns and/or manners to form a focused acoustic wave within channel 22. Where it is desired to position the focal region at the center of channel 22, a plurality of elements, each with a spacing of a multiple of one acoustic wavelength from the desired focal region, may be simultaneously activated. For example, in the embodiment depicted in FIG. 4, elements 32', 32" and 32'" may be simultaneously activated, and if they are spaced such that they are located multiples of one wavelength from a focal region within channel 22 (for example, in the plane of element 32'), a focused acoustic wave will be formed in the channel at the focal region. Thus, where the sum of the radius of channel 22, the thickness of corrosion-proof material 26, and the thickness of inner electrode 34 is approximately 10 microns, and where channel 22 is configured to contain pure water (velocity of longitudinal waves in pure water is approximately 1480 m/s), then the application of a pulse containing a signal with a frequency of approximately 148 MHz may cause the production of a primary acoustic wave with a wavelength of approximately 10 microns, and thus having a focal region in the plane of the element that produced the primary wave. Other elements spaced multiples of this wavelength from the focal region may be simultaneously activated to add constructively with the primary wave, and thus to form a focused wave at the focal region.

Likewise, the focal region may be located at any other desired point within channel 22, either along the length of or radially between the center and side of, channel 22 by selecting suitable combinations of elements which are simultaneously activated according to the following relationship (for a "positive" Fresnel Half-Wave Band pattern having a concentric electrode pattern with an open center; other relationships may describe other electrode patterns):

$$\sqrt{r_n^2 + F^2} - F = \frac{n\lambda_l}{4}$$

where $r_n$ is the inner radius of a selected piezoelectric element 38, F is the focal length of the selected piezoelectric element, $\lambda_l$ is the wavelength of the acoustic wave formed by the selected piezoelectric element at a selected RF frequency, and n=1,3,5, . . . . Alternatively, the location of the focal region within channel 22 may also be varied by varying the frequency of the RF power applied to the piezoelectric element 38.

Inner electrode 34, outer electrode 36 and piezoelectric element 38 may have any suitable dimensions. For example, inner electrode 34, outer electrode 36 and piezoelectric element 38 may each have a width (along the flow direction of channel 22), as narrow as 1–2 microns, as wide as 10–20 microns, or outside of these ranges.

Inner electrode 34, outer electrode 36 and piezoelectric element 36 may also have any desired thickness (along the radial direction of channel 22). For example, inner electrode 35 may have a thickness selected on the basis of how far the inner surface 40 of piezoelectric element 38 is to be located from the center of the channel to position the focal region in a desired location within channel 22. Furthermore, in some embodiments of the invention (described in more detail below), each pumping element 32 may include more than one piezoelectric element. In this situation, the radial thickness of each piezoelectric element and associated electrode pair may be chosen to provide resonance at a more desirable resonant frequency (which is determined by the materials used to form each pumping element, and the thickness of the materials).

Inner electrode 34 and outer electrode 36 may be made from any suitable material. For example, inner electrode 34 and outer electrode 36 may be made from an electrically conductive material selected for its compatibility with a desired manufacturing process. Where inner electrode 34 and outer electrode 36 are made from a material that is resistant to the fluids that are to flow through channel 22, corrosion-resistant layer 36 may be omitted if desired. Examples of suitable materials for inner electrode 34 and outer electrode 36 include, but are not limited to, aluminum, copper, gold, and other electrically conductive materials.

Likewise, piezoelectric element 38 may be made from any suitable piezoelectric material. Examples of suitable materials include, but are not limited to, zinc oxide, quartz, lithium niobate, and lithium titanate. The piezoelectric material used to construct piezoelectric element 38 may be deposited or otherwise formed in any suitable orientation. For example, where piezoelectric element 38 is formed from zinc oxide, the [111] orientation of the zinc oxide may be directed toward the center of channel 22 to direct the acoustic wave toward the center of the channel in the plane of pumping element 32.

Each pumping element 32 may be spaced from adjacent pumping elements 32 by any suitable distance. For example, the spacing of pumping elements 32 may be configured cause the acoustic energy emitted by selected elements to constructively interfere at a desired location by acoustic fresnel focusing. Where RF energy is used to activate pumping elements 32, exemplary distances include, but are not limited to, those in the range of two to six microns. The distance separating adjacent pumping elements 32 may possibly depend upon the desired mode of operation of the pumping elements. For example, adjacent pumping elements 32 may be configured to have different focal points in different locations within channel 22. In this manner, multiple adjacent pumping elements 32 may be activated simultaneously to create a progressively pinched focal region in the direction of fluid flow in the channel by effectively forming a pressure gradient. Likewise, multiple pumping elements 32 may be activated simultaneously to create a larger area of increased pressure within channel 32.

Figure 5:
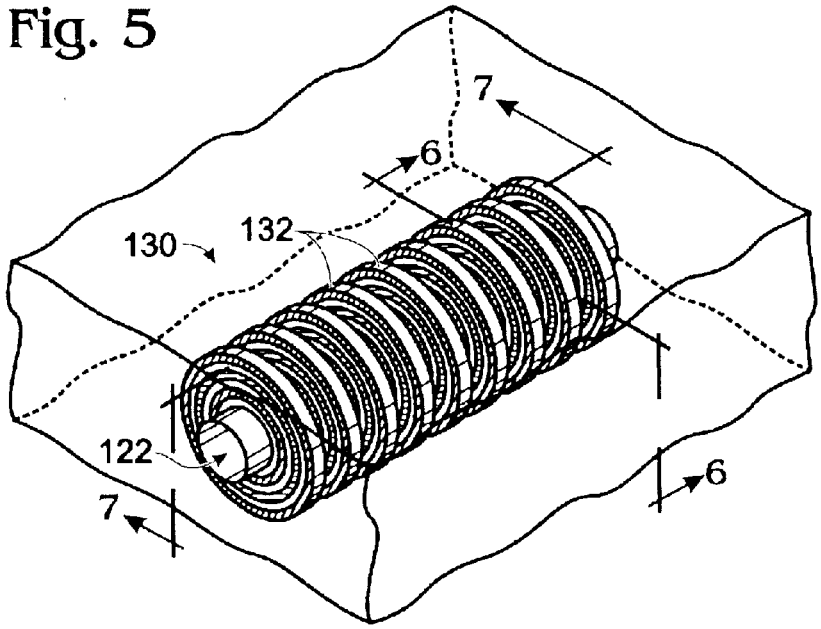
FIG. 5 is an isometric view of a pumping system according to a second embodiment of the present invention.
Figure 6:
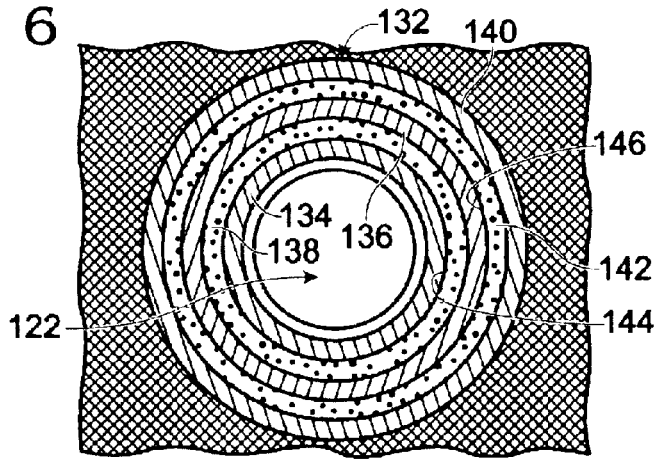
FIG. 6 is a front sectional view of a pumping element taken along line 6—6 of FIG. 5.
Figure 7:
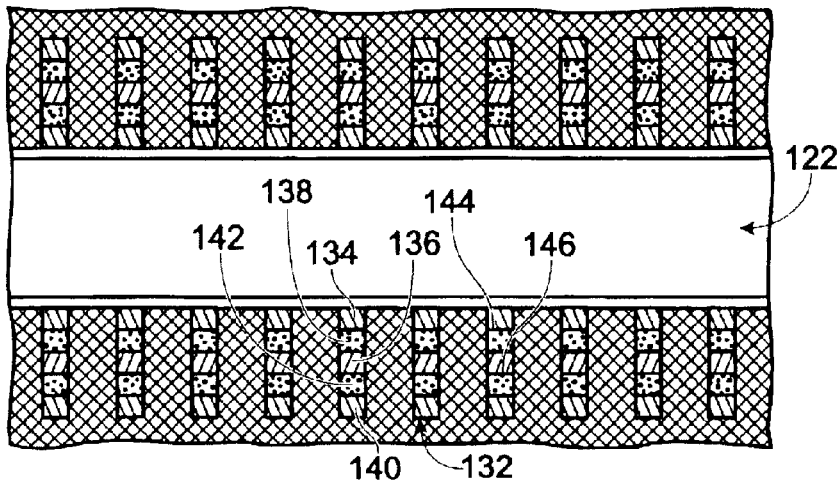
FIG. 7 is a side sectional view of a plurality of pumping elements taken along line 7—7 of FIG. 5.

FIGS. 5–7 show, generally at 130, a second embodiment of a pumping system suitable for use in microfluidic network 14. Pumping system 130 is similar to pumping system 30 in that a series of piezoelectric pumping elements are arranged along the length of a fluid-carrying channel 122 to move a fluid through the channel. Each pumping element 132 may be activated to form an acoustic pressure wave focused at a selected location within the interior of channel 122, and more than one adjacent pumping element may be activated simultaneously as desired to obtain the desired focused acoustic wave. Also, the pattern of activated pumping elements 132 may be shifted along the length of channel 122 to cause the acoustic pressure wave to move along the channel, and thus to move a fluid through the channel via a peristaltic pumping effect.

However, unlike pumping elements 32, pumping elements 132 each include two concentric piezoelectric elements. Referring to FIGS. 6–7, each pumping element 132 includes an inner electrode 134, an intermediate electrode 136, an inner piezoelectric element 138 disposed between the inner electrode and intermediate electrode, an outer electrode 140, and an outer piezoelectric element 142 disposed between the intermediate electrode and the outer electrode.

Pumping system 130 may be operated in different manners to create different pumping effects. For example, a single voltage pulse may be applied simultaneously across inner piezoelectric element 138 and outer piezoelectric element 142. Where the geometries of inner piezoelectric element 138 and outer piezoelectric element 142 are configured to cause the pressure waves from each piezoelectric element to constructively interfere at the same focal region within channel 122, a more powerful pressure wave may be produced relative to the single piezoelectric configuration of pumping elements 32. Alternatively, inner piezoelectric element 138 and outer piezoelectric element 142 may be configured to be individually controllable.

Each of inner electrode 134, intermediate electrode 136, inner piezoelectric element 138, outer electrode 140 and outer piezoelectric element 142 may have any suitable dimensions. For example, the spacing between adjacent pumping elements, and the width of each individual pumping element, may have values within the ranges discussed above for pumping elements 32.

Likewise, inner electrode 134, intermediate electrode 136, inner piezoelectric element 138, outer electrode 140 and outer piezoelectric element 142 each may have any suitable thickness in the radial direction. To avoid problems with destructive interference, the thickness of each of these elements may be selected to set the distances from the inner surface 144 of inner piezoelectric element 138, and from the inner surface 146 of outer piezoelectric element 142, a multiple of the wavelength of the acoustic wave generated by the piezoelectric elements. Because outer piezoelectric element 142 is located farther from the inner wall of channel 122, the different velocities at which the acoustic wave generated by the outer piezoelectric element may travel through the different piezoelectric and electrode layers before reaching channel 120 may need to be taken into account when calculating the location of the focal region.

While the embodiments of FIGS. 2–7 depict pumping elements 32 and 132 having one or two concentric piezoelectric elements, respectively, a pumping element according to the present invention may have three, or even more, concentric piezoelectric elements if desired. Also, while the individual pumping elements are shown as being generally circular in shape, it will be appreciated that the pumping elements may have any other suitable shape, including but not limited to, rectangular or triangular. Furthermore, while the piezoelectric elements of each of the depicted embodiments concentrically surround the associated fluid-carrying channel, the piezoelectric elements may have any other suitable geometric relationship to the fluid-carrying channel and to each other.

Figure 8:
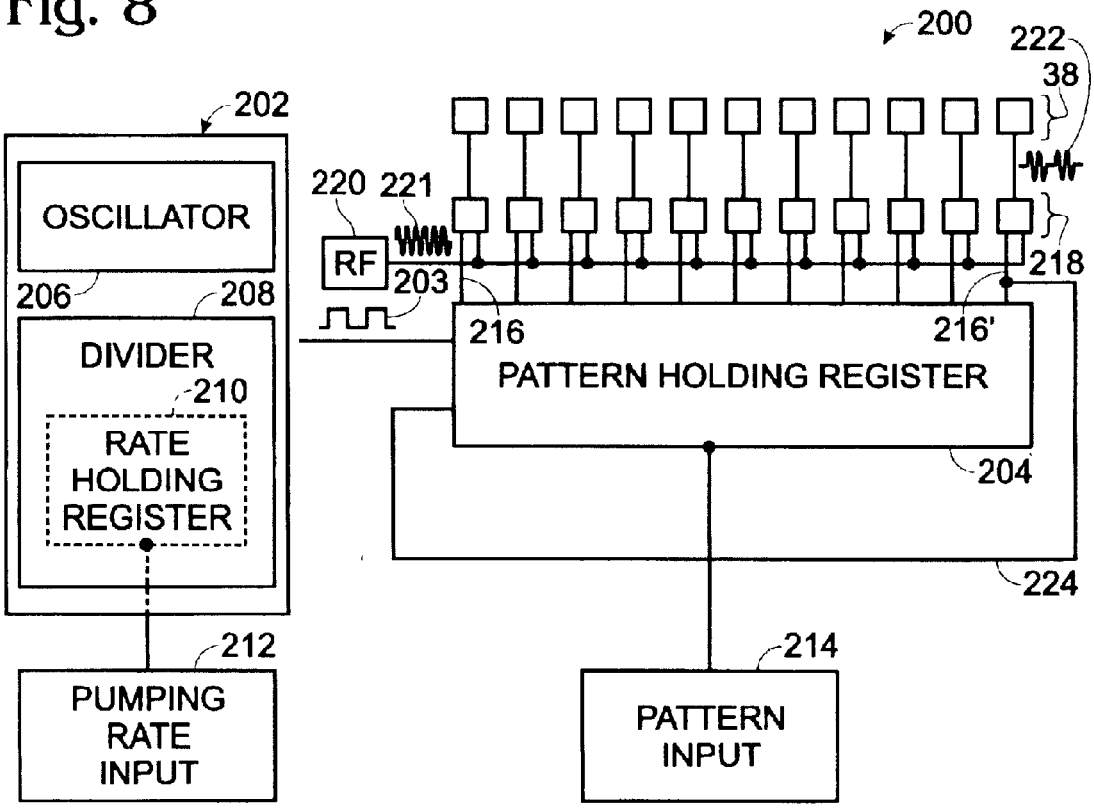
FIG. 8 is a block diagram of an exemplary control system suitable for use with a pumping system according to the present invention.

FIG. 8 shows, generally at 200, a block diagram of an exemplary control system suitable for use with a pumping system according to the present invention. While control system 200 is described below in the context of pumping system 30, it will be appreciated that the discussion applies equally to pumping system 130, or any other suitable pumping system. Control system 200 is configured to create a focused acoustic pressure wave of a fixed profile within channel 22 by activating selected pumping elements 32, and also to move the focused pressure wave along the length of channel 22 to create a peristaltic pumping effect.

Pumping system 200 includes various components that cooperate to create the focused pressure wave and peristaltic pumping effect. First, pumping system 200 includes a programmable rate oscillator, indicated generally at 202. Programmable rate oscillator 202 outputs a pulse train 203 at a selected rate, as described in more detail below, to set a pumping rate. The rate may be user-selected, or specified by system programming. Second, pumping system 200 includes a pattern holding register 204 for holding data representing a selected profile for the focused pressure wave, and for shifting the selected profile along the length of channel 22 at the rate determined by programmable rate oscillator 202 to create the peristaltic pumping effect.

Programmable rate oscillator 202 includes a master oscillator 206 for creating a master clock pulse, and a programmable divider 208 for reducing the frequency of the clock pulse to a selected frequency. Programmable rate oscillator also may include a rate holding register 210 that holds data representing the selected output frequency. Rate holding register 210 may be configured to accept input of a selected pumping rate from a user via pumping rate input device 212, or may contain data representing a fixed pumping rate.

Likewise, pattern holding register 204 may be connected to a pattern input 214 that allows a user to input a selected focal pattern or profile. The focal pattern contains data that sets the shape of the focal pattern to be formed in channel 22. The focal pattern may include any data suitable for forming a selected focal pattern. For example, the focal pattern may include data representing which piezoelectric elements 38 of the plurality of piezoelectric elements are to be simultaneously activated at any selected time.

Furthermore, in some embodiments of the invention, the location of the focal region of each piezoelectric element 38 may be selectively variable. The focal region of a selected piezoelectric element 38 may be varied in any suitable manner. For example, the frequency of the signal contained within the voltage pulse that activates the piezoelectric element may be varied, or different pumping elements may be activated to cause constructive interference at different locations, radial or lengthwise, within the channel. Where the frequency of the signal is varied, the focal pattern held within pattern holding register 204 may include data that indicates the frequency of the activation pulse to be sent to each piezoelectric element.

Pattern holding register 204 may also include a plurality of outputs 216 for providing signals to a set of piezoelectric drivers 218, indicating which piezoelectric elements are to be activated. Each output 216 is in electrical communication with a corresponding piezoelectric driver 218, and each piezoelectric driver is in electrical communication with a corresponding piezoelectric element 38. Each piezoelectric driver 218 is also in electrical communication with a periodic signal source, such as an RF source 220, that outputs a periodic signal 221 of a selected frequency or frequencies. Activation of a selected piezoelectric driver 218 by pattern holding register 204 causes the piezoelectric driver to send a conditioned RF pulse 222 from RF source 220 to the corresponding piezoelectric element 38. This causes the corresponding piezoelectric element 38 to produce an acoustic pressure wave within channel 22. The pulse width of the pulses in pulse train 203 from programmable rate oscillator 202 typically sets the width of RF pulse 222 sent to the piezoelectric elements. Alternatively, piezoelectric drivers 218 may be configured to regulate this pulse width. While the frequency of pulse 222 is described herein as being in the radiofrequency spectrum, pulse 222 may have any other suitable frequency for forming an acoustic wave in a selected channel, depending upon the dimensions of the selected channel.

Pattern holding register 204 may also be configured to move the focal pattern along the length of channel 22. In this manner, the pressure wave formed by each pumping element 32 is moved along the interior of channel 22 to push a fluid through channel 22. Pattern holding register 204 may be configured to shift the focal pattern along the length of channel 22 in any suitable manner. For example, pattern holding register 204 may act as a shift register and move the signal at each output 216 of the pattern holding register to the next adjacent output with each pulse from programmable rate oscillator 202. Alternatively, pattern holding register 204 may be configured to shift the signal at each output 216 by more than one position with each pulse from programmable rate oscillator 202 if desired.

Furthermore, if a continuous pumping action is desired, control system 200 may be configured to shift the selected focal pattern repeatedly along the length of channel 22. The repeated shifting of the selected focal pattern along the length of channel 22 may be accomplished in any suitable manner. In the depicted embodiment, the signal at the last output 216' of pattern holding register 204 may be fed back into the pattern holding register, as indicated at 224, to be applied to a more-upstream output 216. In this configuration, as each output signal of the focal pattern is shifted to the most-downstream output, the output signal is automatically fed back to an earlier output to begin a new movement along channel 22. In this manner, the focal pattern may be continuously recirculated to an upstream point of channel 22, and thus repeatedly shifted along the length of the channel to create a continuous pumping effect. It will be appreciated that the pumping direction of pumping system 32 may be reversed simply by reversing the direction In which pattern holding register 204 moves the focal pattern along channel 22.

Although the present disclosure includes specific embodiments, specific embodiments are not to be considered in a limiting sense, because numerous variations are possible. The subject matter of the present disclosure includes all novel and nonobvious combinations and subcombinations of the various elements, features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements.

What is claimed is:

1. An integrated microfluidic device having a fluidic pumping system for transporting a fluid through the device, the fluidic pumping system comprising:

a fluid-carrying channel formed in the device;

a plurality of acoustic pumping elements disposed along the fluid-carrying channel, wherein the acoustic pumping elements are configured to form an acoustic pressure wave focused within the channel; and a controller in electrical communication with the plurality of acoustic pumping elements, the controller being configured to activate the acoustic pumping elements by supplying pulses of RF power to the acoustic pumping elements in such a manner as to cause the acoustic wave to move along the channel, thereby moving the fluid through the channel.

2. The microfluidic device of claim 1, wherein each acoustic pumping element of the plurality of acoustic pumping elements includes a piezoelectric element.

3. The microfluidic device of claim 2, wherein each piezoelectric element includes a layer of piezoelectric material disposed between a pair of electrodes.

4. The microfluidic device of claim 3, wherein the electrodes and the piezoelectric element have a ring-shaped configuration.

5. The microfluidic device of claim 3, wherein the electrodes and the piezoelectric element have a rectangular-shaped configuration.

6. The microfluidic device of claim 2, wherein each piezoelectric element surrounds the channel.

7. The microfluidic device of claim 6, wherein each piezoelectric element concentrically surrounds the channel.

8. The microfluidic device of claim 6, the channel having a surface, wherein the surface of the channel is at least partially formed from the piezoelectric elements.

9. The microfluidic device of claim 2, wherein each piezoelectric element includes a plurality of layers of piezoelectric material, each layer of piezoelectric material being disposed between a complementary pair of electrodes.

10. An integrated microfluidic device having a fluidic pumping system for transporting a fluid through the device, the fluidic pumping system comprising:

a fluid-carrying channel formed in the device and having a radial inner dimension;

a plurality of acoustic pumping elements disposed along the fluid-carrying channel, wherein the acoustic pumping elements are configured to form an acoustic pressure way focused within the channel; and a controller in electrical communication with the plurality of acoustic pumping elements, the controller being configured to activate the acoustic pumping elements in such a manner as to cause the acoustic wave to move along the channel, thereby moving the fluid through the channel, wherein selected acoustic pumping elements may be activated to form the focused acoustic wave at a focal region at a location within the channel, and wherein the location of the focal region is configured to be positionally variable across the radial inner dimension of the channel.

11. The microfluidic device of claim 10, wherein the piezoelectric element is activated by a pulse of RF power, and wherein the location of the focal region is varied by varying the frequency of the pulse of RF power.

12. The microfluidic device of claim 10, wherein a plurality of piezoelectric elements are simultaneously activated to create a plurality of corresponding acoustic waves that constructively interfere at the focal region, and wherein the location of the focal region is varied by varying which of the plurality of piezoelectric elements are simultaneously activated.

13. An integrated microfluidic device having a fluidic pumping system for transporting a fluid through the device, the fluidic pumping system comprising:

a fluid-carrying channel formed in the device;

a plurality of acoustic pumping elements disposed along the fluid-carrying channel, wherein the acoustic pumping elements are configured to form an acoustic pressure wave focused within the channel; and a controller in electrical communication with the plurality of acoustic pumping elements, the controller being configured to activate the acoustic pumping elements in such a manner as to cause the acoustic wave to move along the channel, thereby moving the fluid through the channel, wherein the controller includes a pattern holding register in electrical communication with the plurality of acoustic elements, the pattern holding register being configured to store data representing a preselected focal pattern that indicates the piezoelectric elements to be activated at a selected time.

14. The microfluidic device of claim 13, wherein the pattern holding register is configured to store data that defines a location of the focal region for each acoustic pumping element.

15. The microfluidic device of claim 13, wherein the pattern holding register is configured to selectively shift the focal pattern along the plurality of acoustic pumping elements in a progressive manner to create a peristaltic pumping effect.

16. The microfluidic device of claim 15, wherein the plurality of acoustic pumping elements includes a first acoustic element and a last acoustic element, and wherein the pattern holding register is configured to shift the data representing a preselected focal pattern from the last acoustic element to the first acoustic element.

17. The microfluidic device of claim 15, further comprising a programmable rate oscillator configured to provide a signal of a preselected frequency to the pattern holding register to set a rate at which the pattern holding register shifts the focal pattern.

18. The microfluidic device of claim 17, wherein the programmable rate oscillator includes a master oscillator to provide a master clock pulse, a programmable divider to reduce the frequency of the master clock pulse to a selected frequency, and a rate holding register for storing a selected pumping rate.

19. The microfluidic device of claim 18, wherein the selected pumping rate is loaded into the rate holding register by a user.

20. The microfluidic device of claim 18, wherein the selected pumping rate is specified by system programming.

21. The microfluidic device of claim 13, wherein the pattern holding register is electrically connected to a plurality of piezoelectric element drivers, each piezoelectric element driver being configured to drive a corresponding piezoelectric element when directed by the pattern holding register.

22. The microfluidic device of claim 13, wherein the pattern holding register is configured to accept an input of a selected focal pattern from an input device.

23. A microfluidic device including a pumping system for moving a fluid through the device, the pumping system comprising:

a channel formed in the device, wherein the channel is configured to accommodate passage of the fluid; and a pumping element associated with the channel, wherein the pumping element includes a plurality of concentric piezoelectric elements configured to produce a focused acoustic wave within the channel to move the fluid through the channel, wherein the concentric piezoelectric elements surround the channel, wherein each concentric piezoelectric element within a selected pumping element is coplanar with the other concentric piezoelectric elements in the selected pumping element, and each pumping element having a focal region, wherein the focal region is coplanar with the concentric piezoelectric elements.

24. The pumping system of claim 23, wherein the piezoelectric elements each include a layer of a piezoelectric material disposed between a pair of electrode rings.

25. The pumping system of claim 24, wherein the pumping elements have a width in the fluid flow direction of between approximately 1 and 20 microns.

26. The pumping system of claim 23, wherein the channel has a diameter of between approximately 10 and 100 microns.

27. The pumping system of claim 23, the channel having a length, further comprising a plurality of pumping elements disposed along the length of the channel.

28. The pumping system of claim 27, wherein each pumping element is spaced from adjacent pumping elements by a distance of between approximately 2 and 6 microns.

29. The pumping system of claim 27, wherein multiple selected pumping elements of the plurality of pumping elements may be activated simultaneously to form a focused acoustic wave within the channel.

30. The pumping system of claim 27, further comprising a controller in electrical communication with the plurality of pumping elements, wherein the controller is configured to activate the pumping elements in such a manner as to produce a variable acoustic wave that moves along the length of the channel to move the fluid through the channel.

31. A microfluidic device for the analysis of a sample in a fluid, the microfluidic device comprising:

a microfluidic network for transporting the fluid through the device, the microfluidic network including a channel configured to accommodate passage of the fluid; and means for pumping the fluid through the channel, wherein the means for pumping the fluid through the channel includes means for holding a focal pattern that defines a location for a focal region for each of the piezoelectric elements.

32. The microfluidic device of claim 31, wherein the means for holding a focal pattern includes means for shifting the focal pattern along the channel.

33. The microfluidic device of claim 32, wherein the means for holding a focal pattern includes means for controlling a rate of movement of the focal pattern along the channel.

34. A method of transporting a fluid in a device, the device including a channel configured to accommodate passage of the fluid and a plurality of acoustic pumping elements disposed along the channel, each acoustic pumping element having a focal region positioned within the channel, the method comprising:

applying a focal pattern to the plurality of acoustic pumping elements, the focal pattern defining a selected subset of the plurality of acoustic pumping elements to be activated simultaneously to create a pressure wave within the channel; and shifting the focal pattern by at least one acoustic pumping element to move the pressure wave along the channel.

35. The method of claim 34, the device including a pattern holding register, further comprising receiving and storing data representing a user-selected focal pattern at the pattern holding register.

36. The method of claim 34, wherein the plurality of acoustic pumping elements includes a first acoustic pumping element and a last acoustic pumping element, and wherein shifting the focal pattern by at least one acoustic pumping element includes shifting the focal pattern from the last acoustic pumping element to the first acoustic pumping element when the focal pattern reaches the last acoustic pumping element.

37. The method of claim 34, wherein applying the focal pattern to the plurality of acoustic pumping elements includes applying a pulse of RF power to selected acoustic pumping elements of the plurality of acoustic pumping elements.

38. The method of claim 34, the device including a rate holding register, further comprising receiving and storing a user-selected pumping rate at the rate holding register.

* * * * *

UNITED STATES PATENT AND TRADEMARK OFFICE

CERTIFICATE OF CORRECTION

PATENT NO. : 6,811,385 B2
DATED : November 2, 2004
INVENTOR(S) : Blakley

It is certified that error appears in the above-identified patent and that said Letters Patent is hereby corrected as shown below:

Column 9,
Line 6, delete "way" and insert therefor -- wave --.

Signed and Sealed this

Nineteenth Day of July, 2005

JON W. DUDAS
*Director of the United States Patent and Trademark Office*